US008847865B2

(12) United States Patent
Ooishi et al.

(10) Patent No.: US 8,847,865 B2
(45) Date of Patent: Sep. 30, 2014

(54) LIQUID CRYSTAL DISPLAY DEVICE THAT SUPPRESSES DETERIORATION OF IMAGE QUALITY

(75) Inventors: Yoshihisa Ooishi, Yokohama (JP); Misa Owa, Kokubunji (JP); Junichi Maruyama, Mobara (JP); Goki Toshima, Chiba (JP)

(73) Assignee: Japan Display Inc., Tokyo (JP)

( * ) Notice: Subject to any disclaimer, the term of this patent is extended or adjusted under 35 U.S.C. 154(b) by 588 days.

(21) Appl. No.: 13/050,979

(22) Filed: Mar. 18, 2011

(65) Prior Publication Data

US 2011/0234569 A1 Sep. 29, 2011

(30) Foreign Application Priority Data

Mar. 23, 2010 (JP) ..... 2010-067062

(51) Int. Cl.
*G09G 3/36* (2006.01)

(52) U.S. Cl.
CPC ..... *G09G 3/3648* (2013.01); *G09G 2320/0285* (2013.01); *G09G 2310/0205* (2013.01); *G09G 2320/041* (2013.01); *G09G 2310/0251* (2013.01)
USPC ..... 345/89; 345/87

(58) Field of Classification Search
USPC ..... 345/87, 88, 89
See application file for complete search history.

(56) References Cited

U.S. PATENT DOCUMENTS

| | | | | |
|---|---|---|---|---|
| 7,061,464 | B2 * | 6/2006 | Park et al. | 345/98 |
| 8,305,374 | B2 | 11/2012 | Lee | |
| 8,446,352 | B2 * | 5/2013 | You | 345/89 |
| 2001/0005193 | A1 * | 6/2001 | Yokoyama | 345/92 |
| 2004/0183761 | A1 * | 9/2004 | Miyachi et al. | 345/87 |
| 2006/0158415 | A1 | 7/2006 | Izumi | |
| 2007/0046609 | A1 | 3/2007 | Lee | |
| 2007/0097057 | A1 | 5/2007 | Shin | |
| 2007/0247413 | A1 | 10/2007 | Maruyama et al. | |
| 2008/0018630 | A1 | 1/2008 | Fujino | |
| 2008/0284707 | A1 | 11/2008 | Katagawa | |
| 2009/0102766 | A1 | 4/2009 | Oke et al. | |
| 2010/0220938 | A1 | 9/2010 | Higuchi | |
| 2010/0231617 | A1 * | 9/2010 | Ueda et al. | 345/690 |

FOREIGN PATENT DOCUMENTS

| | | |
|---|---|---|
| CN | 1804986 | 7/2006 |
| CN | 1924649 | 3/2007 |
| CN | 101231831 | 7/2008 |
| CN | 101320539 | 12/2008 |
| JP | 2005-140883 | 6/2005 |

(Continued)

*Primary Examiner* — Chanh Nguyen
*Assistant Examiner* — Roy Rabindranath
(74) *Attorney, Agent, or Firm* — Antonelli, Terry, Stout & Kraus, LLP.

(57) ABSTRACT

A data line driving section (6) outputs a video signal voltage for each pixel to a data line (DL) for each predetermined period in order. In outputting a video signal voltage for a pixel, the data line driving section (6) outputs a gradation signal voltage having a voltage corresponding to a gradation value of the pixel as the video signal voltage during a second part of the predetermined period, and outputs a correction gradation signal voltage different from the gradation signal voltage as the video signal voltage during a first part of the predetermined period. A control section (4) changes a relationship between the correction gradation signal voltage and the gradation signal voltage based on a combination of the gradation value of the pixel and a gradation value of a pixel preceding the pixel.

13 Claims, 15 Drawing Sheets

(56) References Cited

FOREIGN PATENT DOCUMENTS

| | | |
|---|---|---|
| JP | 2007-65657 | 3/2007 |
| JP | 2007-128035 | 5/2007 |
| JP | 2007-292900 | 11/2007 |
| JP | 2008-116564 | 5/2008 |
| JP | 2008-209890 | 9/2008 |
| JP | 2009-42289 | 2/2009 |
| WO | WO 2009/060656 | 5/2009 |

* cited by examiner

FIG.9

| LUT | | CONDITION RELATED TO n | | | | | | | |
|---|---|---|---|---|---|---|---|---|---|
| | | \|n\| = 0 | \|n\| = 16 | \|n\| = 32 | \|n\| = 48 | \|n\| = 64 | ··· | \|n\| = 240 | \|n\| = 255 |
| CONDITION RELATED TO n−1 | \|n−1\| = 0 | Δs = 0 | Δs = 5 | Δs = 7 | Δs = 10 | Δs = 12 | ··· | Δs = 28 | Δs = 30 |
| | \|n−1\| = 16 | Δs = 3 | Δs = 0 | Δs = 5 | Δs = 8 | Δs = 10 | ··· | Δs = 26 | Δs = 27 |
| | \|n−1\| = 32 | Δs = 6 | Δs = 4 | Δs = 0 | Δs = 3 | Δs = 5 | ··· | Δs = 23 | Δs = 25 |
| | \|n−1\| = 48 | Δs = 9 | Δs = 6 | Δs = 4 | Δs = 0 | Δs = 3 | ··· | Δs = 20 | Δs = 21 |
| | \|n−1\| = 64 | Δs = 13 | Δs = 10 | Δs = 8 | Δs = 5 | Δs = 0 | ··· | Δs = 18 | Δs = 20 |
| | ··· | ··· | ··· | ··· | ··· | ··· | ··· | ··· | ··· |
| | \|n−1\| = 240 | Δs = 28 | Δs = 27 | Δs = 23 | Δs = 20 | Δs = 19 | ··· | Δs = 0 | Δs = 5 |
| | \|n−1\| = 255 | Δs = 30 | Δs = 29 | Δs = 27 | Δs = 24 | Δs = 22 | ··· | Δs = 3 | Δs = 0 |

| CONDITION | $\gamma$ |
|---|---|
| 0°C ~ 25°C | $\gamma 1$ |
| ~ | $\gamma 2$ |

LIQUID CRYSTAL DISPLAY DEVICE THAT SUPPRESSES DETERIORATION OF IMAGE QUALITY

CROSS-REFERENCE TO RELATED APPLICATION

The present application claims priority from Japanese application JP 2010-067062 filed on Mar. 23, 2010, the content of which is hereby incorporated by reference into this application.

BACKGROUND OF THE INVENTION

1. Field of the Invention

The present invention relates to a liquid crystal display device.

2. Description of the Related Art

When a liquid crystal display device is driven at a high refresh rate, a period during which a video signal may be input to a pixel electrode is short. Therefore, there has been known a problem that a potential of the pixel electrode does not reach to a desired potential and thus image quality deteriorates.

Therefore, in JP 2008-209890 A, the following measures are taken to suppress the deterioration of image quality. That is, during a horizontal period (or 1H period), a voltage obtained by adding a predetermined voltage to a gradation voltage corresponding to a gradation value is input as the video signal to the pixel electrode, and then the gradation voltage is input as the video signal to the pixel electrode. This is a driving method called pre-charging.

SUMMARY OF THE INVENTION

In recent years, a liquid crystal display device in which a liquid crystal is driven at a high speed, for example, a double speed (120 Hz) or a quadruple speed (240 Hz) appears. In such a liquid crystal display device, each horizontal period is short, and hence a writing time to a pixel electrode shortens. Therefore, it is necessary to more efficiently perform pre-charging.

An object of the present invention is to more reliably suppress deterioration of image quality in a case where a liquid crystal display device is driven at a high refresh rate.

In order to solve the above-mentioned problem, there is provided a liquid crystal display device, including: a plurality of pixels each including a pixel electrode and a thin film transistor having a source connected to the pixel electrode; a video signal line connected to a drain of the thin film transistor included in each of the plurality of pixels; output means for outputting, to a gate of the thin film transistor, an on-voltage for turning on the thin film transistor included in corresponding one of the plurality of pixels for each of the plurality of pixels in a predetermined order; and video signal output means for outputting, to the video signal line, a video signal voltage for the corresponding one of the plurality of pixels for each of the plurality of pixels in the predetermined order, in which the video signal output means outputs a reference video signal voltage having a voltage corresponding to a gradation value of the corresponding one of the plurality of pixels as the video signal voltage for the corresponding one of the plurality of pixels during a first part of a period during which the video signal voltage for the corresponding one of the plurality of pixels is output, and outputs a correction video signal voltage having a voltage different from the reference video signal voltage as the video signal voltage for the corresponding one of the plurality of pixels during a second part preceding the first part of the period, and the liquid crystal display device further includes control means for changing a relationship between the reference video signal voltage and the correction video signal voltage for the corresponding one of the plurality of pixels based on a combination of the gradation value of the corresponding one of the plurality of pixels and a gradation value of another one of the plurality of pixels which precedes the corresponding one of the plurality of pixels.

According to one aspect of the present invention, the output means may start to output the on-voltage for turning on the thin film transistor included in the corresponding one of the plurality of pixels when the video signal output means outputs a video signal voltage for the another one of the plurality of pixels which precedes the corresponding one of the plurality of pixels.

Further, according to one aspect of the present invention, the liquid crystal display device may further include correction means for correcting the gradation value of the corresponding one of the plurality of pixels to obtain a correction gradation value of the corresponding one of the plurality of pixels, the video signal output means may output the correction video signal voltage having a voltage corresponding to the correction gradation value of the corresponding one of the plurality of pixels as the video signal voltage for the corresponding one of the plurality of pixels, and the control means may control a correction amount used when the correction means corrects the gradation value of the corresponding one of the plurality of pixels, based on the gradation value of the corresponding one of the plurality of pixels and the gradation value of the another one of the plurality of pixels which precedes the corresponding one of the plurality of pixels.

Further, according to one aspect of the present invention, the control means may change the relationship between the reference video signal voltage and the correction video signal voltage for the corresponding one of the plurality of pixels based on a position of the corresponding one of the plurality of pixels and the combination of the gradation value of the corresponding one of the plurality of pixels and the gradation value of the another one of the plurality of pixels which precedes the corresponding one of the plurality of pixels.

Further, according to one aspect of the present invention, the liquid crystal display device further includes: correction means for correcting the gradation value of the corresponding one of the plurality of pixels to obtain a correction gradation value of the corresponding one of the plurality of pixels; and storage means for storing a table in which a condition related to the gradation value of the corresponding one of the plurality of pixels, a condition related to the gradation value of the another one of the plurality of pixels which precedes the corresponding one of the plurality of pixels, and correction amount control information are associated with one another, for each of the plurality of pixels.

The video signal output means may output the correction video signal voltage having a voltage corresponding to the correction gradation value of the corresponding one of the plurality of pixels as the video signal voltage for the corresponding one of the plurality of pixels, and the control means may determine a correction amount used when the correction means corrects the gradation value of the corresponding one of the plurality of pixels, based on the correction amount control information associated with the condition satisfied by the gradation value of the corresponding one of the plurality of pixels and the condition satisfied by the gradation value of the another one of the plurality of pixels which precedes the corresponding one of the plurality of pixels in the table for the corresponding one of the pixels.

Further, according to one aspect of the present invention, the second part of the period during which the video signal output means outputs the video signal voltage for the corresponding one of the plurality of pixels may be changed based on a position of the corresponding one of the plurality of pixels.

Further, according to one aspect of the present invention, when the gradation value of the corresponding one of the plurality of pixels satisfies a predetermined condition, the video signal output means may output the correction video signal voltage having a voltage exceeding a voltage corresponding to a maximum gradation as the video signal voltage for the corresponding one of the plurality of pixels.

Further, according to one aspect of the present invention, the control means may include correction means for correcting the gradation value of the corresponding one of the plurality of pixels based on a correction amount corresponding to a combination of the gradation value of the corresponding one of the plurality of pixels and the gradation value of the another one of the plurality of pixels which precedes the corresponding one of the plurality of pixels to obtain a correction gradation value of the corresponding one of the plurality of pixels, the video signal output means may output the correction video signal voltage having a voltage corresponding to the correction gradation value of the corresponding one of the plurality of pixels as the video signal voltage for the corresponding one of the plurality of pixels, and the correction means may obtain a gradation value exhibiting a gradation higher than a maximum gradation as the correction gradation value of the corresponding one of the plurality of pixels when the gradation value of the corresponding one of the plurality of pixels satisfies the predetermined condition.

Further, according to one aspect of the present invention, when the gradation value of the corresponding one of the plurality of pixels satisfies a predetermined condition, the video signal output means may output the correction video signal voltage having a voltage different in polarity from a reference video signal voltage for the another one of the plurality of pixels which precedes the corresponding one of the plurality of pixels as the video signal voltage for the corresponding one of the plurality of pixels.

Further, according to one aspect of the present invention, the control means may include correction means for correcting the gradation value of the corresponding one of the plurality of pixels based on a correction amount corresponding to a combination of the gradation value of the corresponding one of the plurality of pixels and the gradation value of the another one of the plurality of pixels which precedes the corresponding one of the plurality of pixels to obtain a correction gradation value of the corresponding one of the plurality of pixels, the video signal output means may output the correction video signal voltage having a voltage corresponding to the correction gradation value of the corresponding one of the plurality of pixels as the video signal voltage for the corresponding one of the plurality of pixels, and the correction means may obtain a correction gradation value different in sign from the gradation value of the another one of the plurality of pixels which precedes the corresponding one of the plurality of pixels when the gradation value of the corresponding one of the plurality of pixels satisfies the predetermined condition.

Further, according to one aspect of the present invention, the liquid crystal display device may further include temperature detection means for detecting a temperature, and the control means may change the relationship between the reference video signal voltage and the correction video signal voltage for the corresponding one of the plurality of pixels based on the combination of the gradation value of the corresponding one of the plurality of pixels and the gradation value of the another one of the plurality of pixels which precedes the corresponding one of the plurality of pixels and the temperature detected by the temperature detection means.

Further, according to one aspect of the present invention, the control means may change the relationship between the reference video signal voltage and the correction video signal voltage for a first pixel of the plurality of pixels based on a combination of a gradation value of the first pixel and a gradation value exhibiting a minimum gradation.

Further, according to one aspect of the present invention, the video signal output means may output a video signal voltage for a first pixel of the plurality of pixels for a period longer than a period of a video signal voltage for another one of the plurality of pixels.

BRIEF DESCRIPTION OF THE DRAWINGS

In the accompanying drawings:

FIG. 9 illustrates an example of storage contents of a lookup table (LUT);

DETAILED DESCRIPTION OF THE INVENTION

Hereinafter, an embodiment of the present invention is described in detail with reference to the attached drawings.

[Liquid Crystal Display Device]

Figure 1:
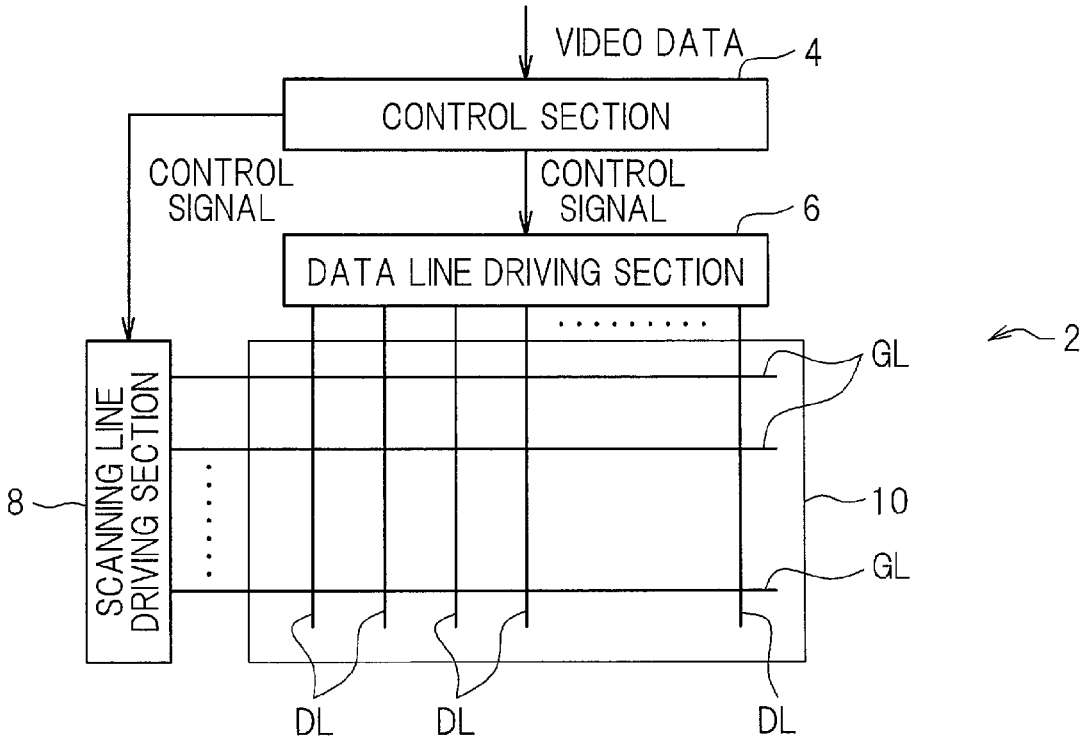
FIG. 1 is a structural diagram illustrating a liquid crystal display device according to an embodiment of the present invention.

FIG. 1 is a structural diagram illustrating a liquid crystal display device 2 according to the embodiment of the present invention. As illustrated in FIG. 1, the liquid crystal display device 2 includes a control section 4, a data line driving section 6, a scanning line driving section 8, and a liquid crystal panel 10 which includes a plurality of data lines DL connected to the data line driving section 6 and a plurality of scanning lines GL connected to the scanning line driving section 8. Although not illustrated in FIG. 1, the liquid crystal display device 2 includes a backlight unit and storage means (for example, line memory).

The liquid crystal display device 2 is realized as, for example, a liquid crystal display using an in-plane switching (IPS) mode as a display mode. In this embodiment, the liquid crystal display device 2 displays an image at a refresh rate selected from a plurality of refresh rates by a user.

[Liquid Crystal Panel]

Figure 2:
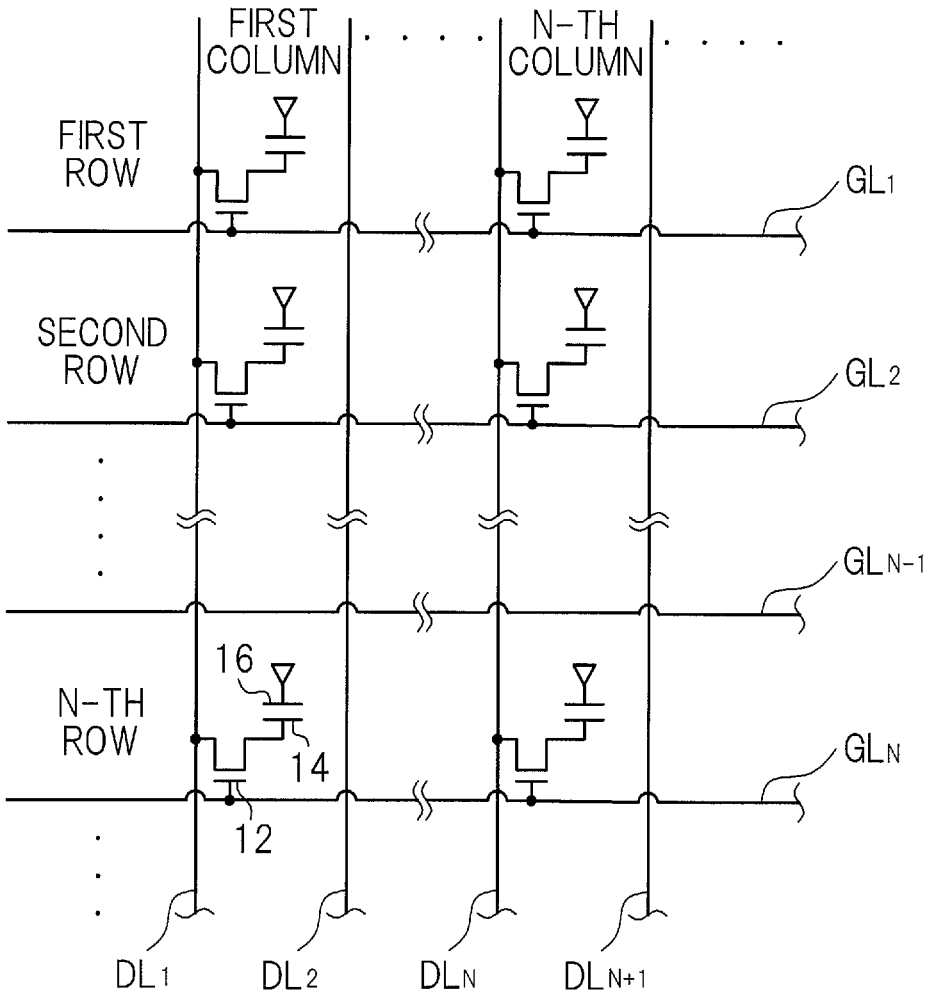
FIG. 2 illustrates a liquid crystal panel.

FIG. 2 illustrates the liquid crystal panel 10. The liquid crystal panel 10 includes a first substrate, a second substrate, and a liquid crystal layer filled between the first and second substrates, which are not illustrated.

The plurality of data lines DL extending in a longitudinal direction and the plurality of scanning lines GL extending in a lateral direction are arranged in the first substrate (see FIG. 2). Hereinafter, an N (N=1, 2, . . . )-th data line DL counted from the left is referred to as a data line $DL_N$ and an N (N=1, 2, . . . )-th scanning line GL counted from above is referred to as a scanning line $GL_N$.

Pixels which include thin film transistors 12 (hereinafter, referred to as TFTs) 12, pixel electrodes 14 connected to sources of the TFTs 12, and a common electrode 16 are arranged in matrix in the first substrate. When the display mode of the liquid crystal display device 2 is, for example, a vertical alignment (VA) mode, the common electrode 16 is provided in the second substrate.

[Pixel]

Figure 3:
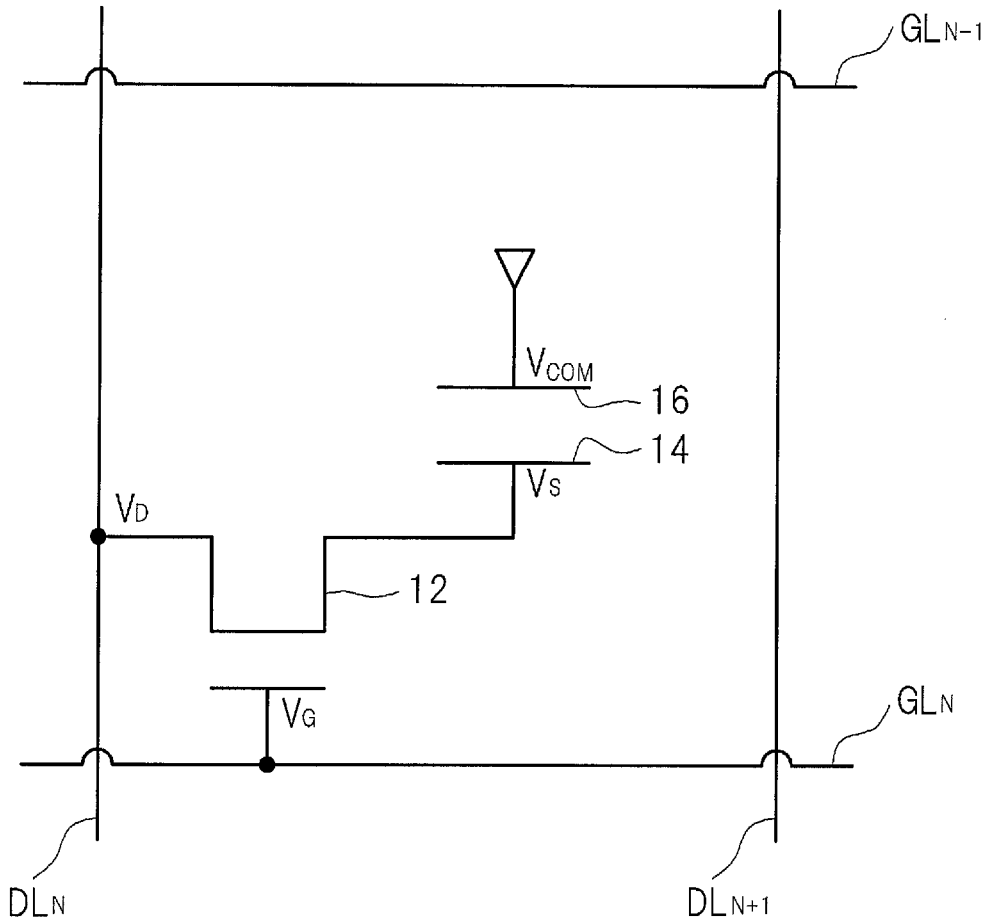
FIG. 3 illustrates a pixel.

FIG. 3 illustrates a pixel which is located in the N-th row and the N-th column (see FIG. 2). As illustrated in FIG. 3, the pixel is located in the N-th column, and hence a drain of the TFT 12 is connected to the N-th data line $DL_N$ counted from the left. The pixel is located in the N-th row, and hence a gate of the TFT 12 is connected to the N-th scanning line $GL_N$ counted from above. Note that, $V_G$ indicates a potential of the gate of the TFT 12, $V_D$ indicates a potential of the drain of the TFT 12, and $V_S$ indicates a potential of the source of the TFT 12. The potential $V_S$ corresponds to a potential of the pixel electrode 14. In addition, $V_{COM}$ indicates a potential of the common electrode 16.

[Control Section]

The control section 4 (see FIG. 1) is a control circuit, for example, a microcomputer or a microprocessor, and controls the data line driving section 6 and the scanning line driving section 8. To be specific, the control section 4 generates control signals to control the data line driving section 6 and the scanning line driving section 8 and outputs the control signals to the data line driving section 6 and the scanning line driving section 8. Video data of each frame is successively input to the control section 4. The video data is data including gradation values of respective pixels. Each of the gradation values is numerical data indicating a gradation. In this embodiment, the gradation value is an integer value in a range of 0 to 255. When the gradation value is 255, the gradation value exhibits a maximum gradation. When the gradation value is 0, the gradation value exhibits a minimum gradation.

[Gradation Signal Voltage]

Figure 4:
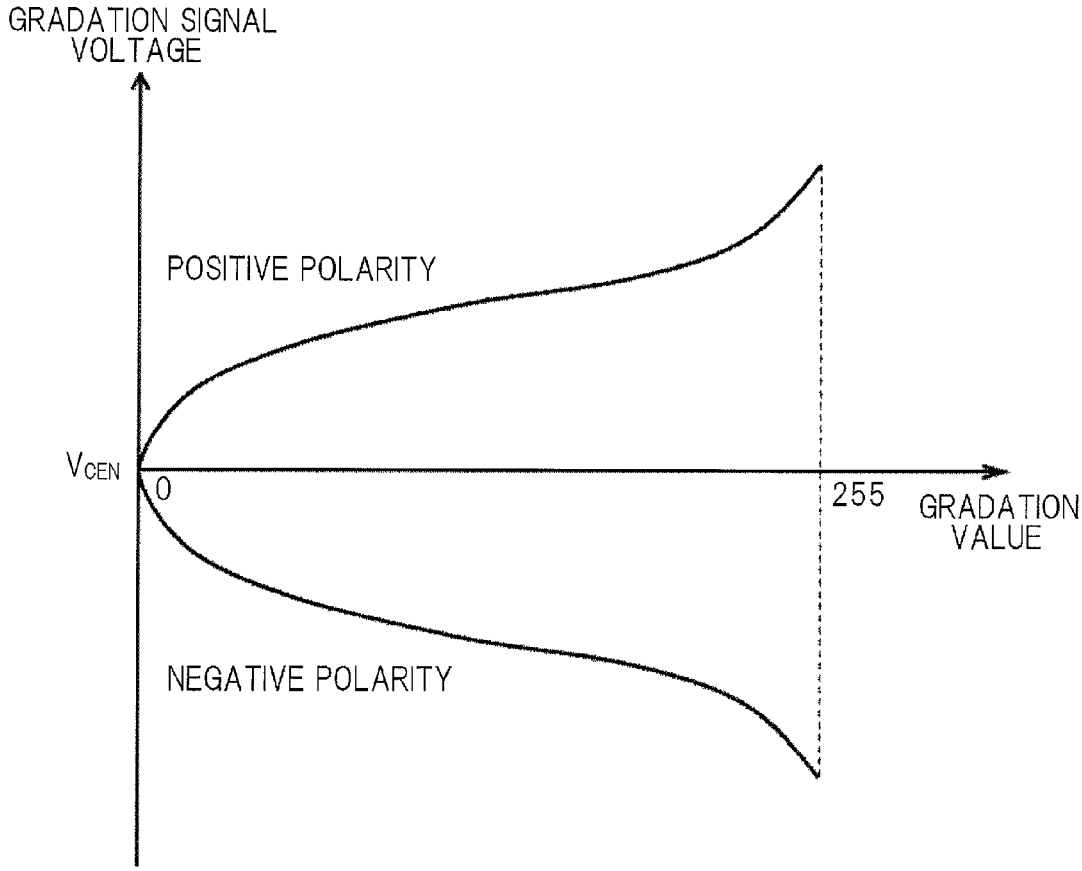
FIG. 4 illustrates a relationship between a gradation value and a gradation signal voltage.

FIG. 4 illustrates a relationship between the gradation value and a gradation signal voltage. As illustrated in FIG. 4, in this embodiment, each video data has two gradation signal voltages. The two gradation signal voltages of each video data are obtained by reversing the polarity of the potential $V_S$ of the pixel electrode 14 relative to $V_{CEN}$. To be specific, when the potential $V_S$ is higher than $V_{CEN}$, the potential $V_S$ has a positive polarity. When the voltage $V_S$ is lower than $V_{CEN}$, the voltage $V_S$ has a negative polarity.

[Scanning Line Driving Section and Data Line Driving Section]

The scanning line driving section (output means) 8 outputs an on-voltage to each of the scanning lines GL for each predetermined time in accordance with the control signal. To be specific, the scanning line driving section 8 outputs the on-voltage in order from above (in order from scanning line $GL_1$). As a result, the on-voltage is output, in order from a top pixel row, to each pixel included in the pixel row (to be precise, gate of TFT 12 of pixel included in pixel row).

Figure 5:
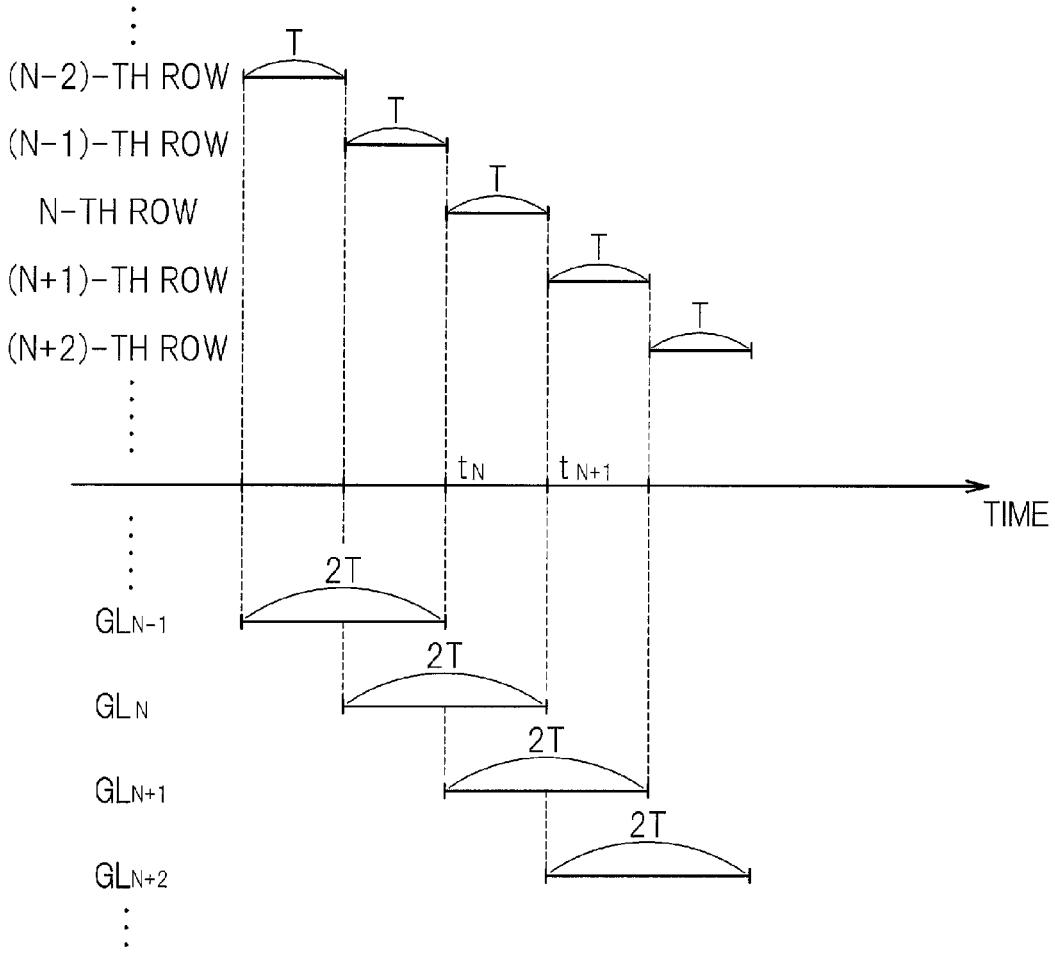
FIG. 5 illustrates an operation of a scanning line driving section and an operation of a data line driving section.

FIG. 5 illustrates an operation of the scanning line driving section 8 and an operation of the data line driving section 6. Periods during which the on-voltages are output to the corresponding scanning lines GL for the respective scanning lines GL are illustrated below a time axis exhibiting a lapse of time. As illustrated in FIG. 5, the on-voltage is output to each of the scanning lines GL for a period of 2×T (hereinafter, referred to as on-voltage output period) in order from above.

As described above, the on-voltage is output in order from above, and hence the N-th on-voltage is output to the N-th scanning line $GL_N$ counted from above.

Figure 6:
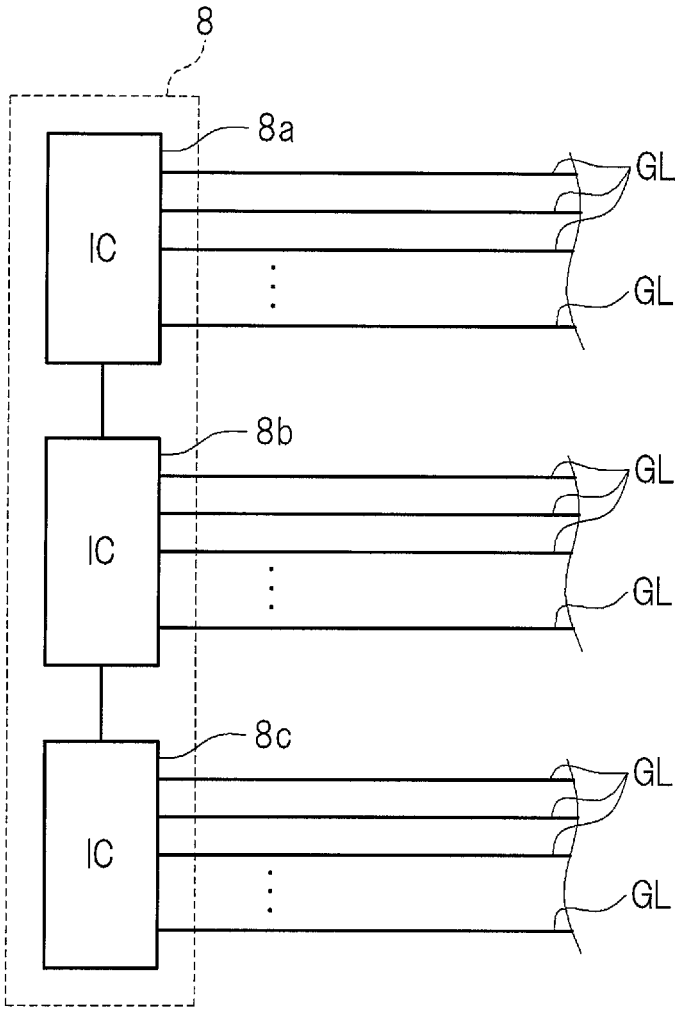
FIG. 6 is a structural diagram illustrating the scanning line driving section.

In this embodiment, the scanning line driving section 8 includes a plurality of scanning line driver ICs. FIG. 6 is a structural diagram illustrating the scanning line driving section 8 in this embodiment. As illustrated in FIG. 6, the scanning line driving section 8 includes a scanning line driver IC 8*a*, a scanning line driver IC 8*b* connected to the scanning line driver IC 8*a*, and a scanning line driver IC 8*c* connected to the scanning line driver IC 8*b*, which are provided in order from above.

As illustrated in FIG. 6, each of the scanning line driver ICs 8*a*, 8*b*, and 8*c* is connected to a plurality of scanning lines GL. Each of the scanning line driver ICs outputs the on-voltages to the scanning lines GL connected thereto. To be specific, the scanning line driver IC 8*a* outputs the on-voltage to each of the scanning lines GL and outputs the on-voltage to the scanning line driver IC 8*b*. The scanning line driver IC 8*b* outputs the on-voltage output from the scanning line driver IC 8*a* to each of the scanning lines GL and outputs the on-voltage to the scanning line driver IC 8*c*. The scanning line driver IC 8*c* outputs the on-voltage output from the scanning line driver IC 8*b* to each of the scanning lines GL.

[Data Line Driving Section]

The data line driving section 6 repeatedly outputs the video signal voltage to each of the data lines DL for each predetermined period T in accordance with the control signal output from the control section 4.

To be specific, the data line driving section 6 outputs, to the data line $DL_N$ (video signal line), a voltage based on a gradation value for the N-th-column pixel (to be precise, pixel in which drain of TFT 12 is connected to data line $DL_N$) as the video signal voltage for the corresponding pixel. In this case, the data line driving section 6 outputs the N-th video signal voltage for the N-th-row pixel to the data line $DL_N$. When attention is focused on the data line $DL_N$, as a result, the data line driving section 6 (video signal output means) successively outputs the video signal voltage for corresponding pixel to the data line $DL_N$ for each of N-th-column pixels.

Hereinafter, the period T during which each video signal voltage is output from the data line driving section 6 is referred to as a video signal output period.

The video signal voltage is output in accordance with a timing when the on-voltage is output from the scanning line driving section 8 to each of the scanning lines GL. That is, while the on-voltage is output from the scanning line driving section 8 to the scanning line $GL_N$, the video signal voltage for the N-th-row pixel (to be precise, pixel in which gate of TFT 12 is connected to scanning line $GL_N$) is output. In other words, while the video signal voltage for the N-th-row pixel is output, the on-voltage is output to the scanning line $GL_N$. In FIG. 5, periods during which video signal voltages for corresponding-row pixels are output for respective rows are illustrated above the time axis. In this case, $t_N$ indicates a timing when the output of the video signal voltage for the N-th-row pixel starts, and $t_{N+1}$ indicates a timing when the output of the video signal voltage for the N-th-row pixel is completed. As described above, while the video signal voltage for the N-th-row pixel is output, the on-voltage is output to the scanning line $GL_N$.

As is also apparent from FIG. 5, the output of the on-voltage to the scanning line $GL_N$ is started simultaneously with the output of a video signal voltage for an (N−1)-th-row pixel. Therefore, the output of the on-voltage to the scanning line $GL_N$ is performed even while a video signal voltage for a pixel located in a row preceding the N-th row is output (see FIG. 5). This reason is as follows.

The scanning line driving section 8 has the structure illustrated in FIG. 6, and hence a total wiring resistance value increases with a downward shift because of resistances of wiring lines connecting the ICs to each other. Therefore, a rising speed of the potential $V_G$ reduces with the downward shift. As a result, a timing when the TFT 12 is turned on is delayed with the downward shift. Therefore, the output of the on-voltage to the scanning line $GL_N$ is started simultaneously with the output of the video signal voltage for the pixel located in the row preceding the N-th row so that the TFT 12 of the N-th-row pixel is reliably in the on state while the video signal voltage for the N-th-row pixel is output even in a case where a refresh rate is high.

[With Respect to Refresh Rate]

When the refresh rate is high (for example, 240 Hz), the video signal output period shortens. As a result, a period during which the video signal voltage is input to the drain of the TFT 12 shortens. Therefore, there is a problem that the video signal output period is completed before the drain voltage $V_D$ of the TFT 12 and the potential $V_S$ of the pixel electrode 14 each become the potential corresponding to the gradation value and thus the image quality deteriorates.

In order to solve the problem, the liquid crystal display device 2 is designed as follows so that the drain voltage $V_D$ of the TFT 12 becomes a target potential at the shortest time and then the potential $V_S$ of the pixel electrode 14 reaches to the target potential.

That is, in the liquid crystal display device 2, the data line driving section 6 does not output, as the video signal voltage, a gradation signal voltage (reference video signal voltage) having a voltage corresponding to a gradation value for the entire video signal output period. In order to increase a change speed of the drain voltage $V_D$ of the TFT 12, the data line driving section 6 first outputs, as the video signal voltage, a correction gradation signal voltage different from the gradation signal voltage, and then outputs the gradation signal voltage as the video signal voltage.

Figure 7A:
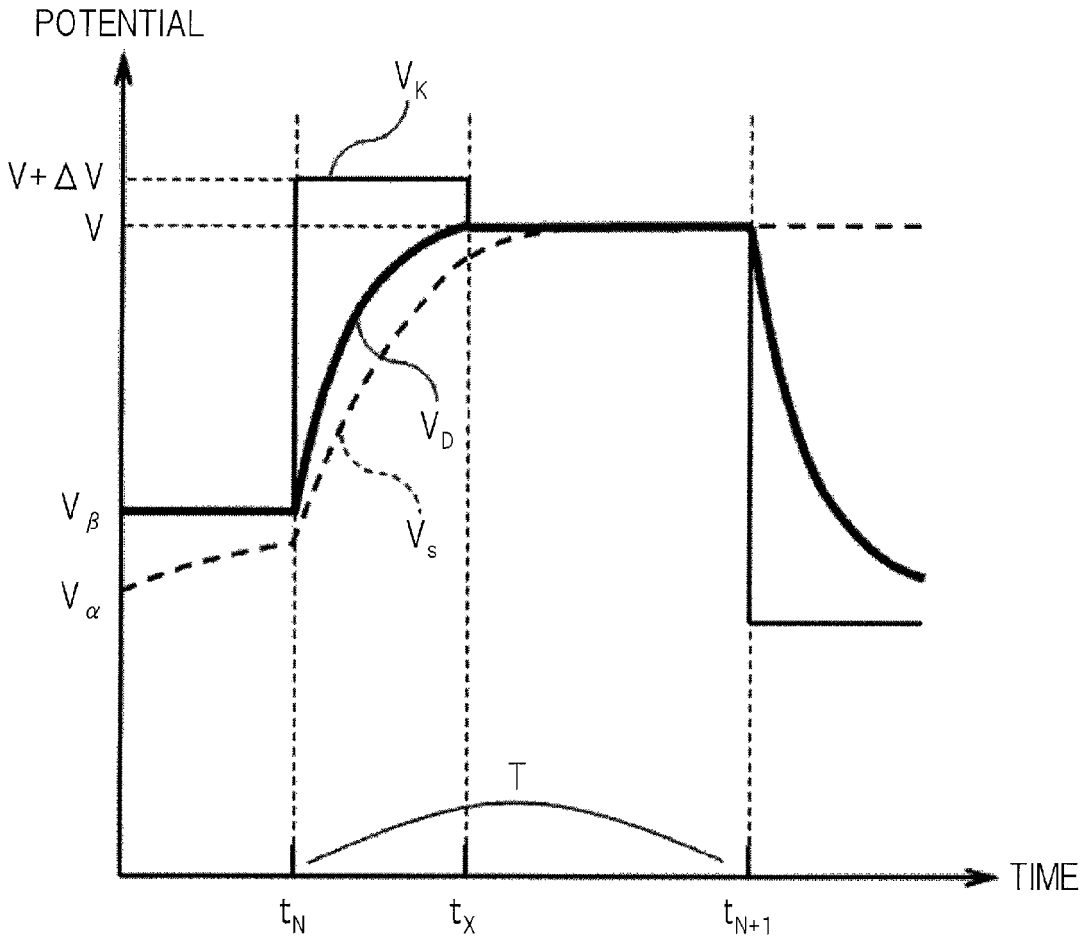
FIGS. 7A and 7B illustrate changes in video signal voltage and pixel electrode potential during a video signal output period.

FIG. 7A illustrates the design described above, that is, changes in video signal voltage $V_K$ output from the data line driving section 6, drain voltage $V_D$ of the TFT 12, and potential $V_S$ of the pixel electrode 14 during the video signal output period. In this case, attention is focused on the pixel located in the N-th row and N-th column (hereinafter, referred to as pixel of interest). Assume that $V_S$ indicates a potential of the pixel electrode 14 of the pixel of interest and $V_D$ indicates a voltage input to the drain of the TFT 12 of the pixel of interest.

The period from $t_N$ to $t_{N+1}$ is the video signal output period during which the video signal voltage $V_K$ for the pixel of interest is output from the data line driving section 6. That is, the period from $t_N$ to $t_{N+1}$ is the video signal output period during which the video signal voltage $V_K$ for the N-th-row pixel is output. In this case, a period from $t_N$ to $t_X$ is a period during which the correction gradation signal voltage is output as the video signal voltage $V_K$ for the pixel of interest to the data line $DL_N$ (second period), and a period from $t_X$ to $t_{N+1}$ is a period during which the gradation signal voltage is output as the video signal voltage $V_K$ for the pixel of interest to the data line $DL_N$ (first period).

A period up to $t_N$ is a part of the video signal output period during which the video signal voltage $V_K$ for a pixel preceding the pixel of interest by one row is output from the data line driving section 6. That is, the period up to $t_N$ is the part of the video signal output period during which the video signal voltage $V_K$ for the (N−1)-th-row pixel is output.

Therefore, V+ΔV which is a value of $V_K$ during the period from $t_N$ to $t_X$ indicates the potential of the correction gradation signal voltage and V which is a value of $V_K$ during the period from $t_X$ to $t_{N+1}$ indicates the potential of the gradation signal voltage. In addition, ΔV indicates a potential difference between the gradation signal voltage and the correction gradation signal voltage. Further, $V_\beta$ which is a value of $V_K$ during the period before $t_N$ indicates a potential of the video signal voltage $V_K$ for the pixel preceding the pixel of interest by one row. To be more precise, $V_\beta$ indicates the potential of the gradation signal voltage output as the video signal voltage $V_K$ for the pixel preceding the pixel of interest by one row.

In addition, $V_\alpha$ indicates a value of $V_S$ at the start time $t_N$ of the video signal output period.

As illustrated in FIG. 7A, in the liquid crystal display device 2, the correction gradation signal voltage different from the gradation signal voltage is output during the period from $t_N$ to $t_X$. Therefore, before the time $t_{N+1}$ when the video signal output period is completed, $V_D$ reaches to the target potential V of the gradation signal voltage and $V_S$ reaches to the target potential V as well (see FIG. 7A).

A case where ΔV is constant is assumed. In this case, the deterioration of image quality may be less suppressed than expected. This point is described below.

Figure 7B:
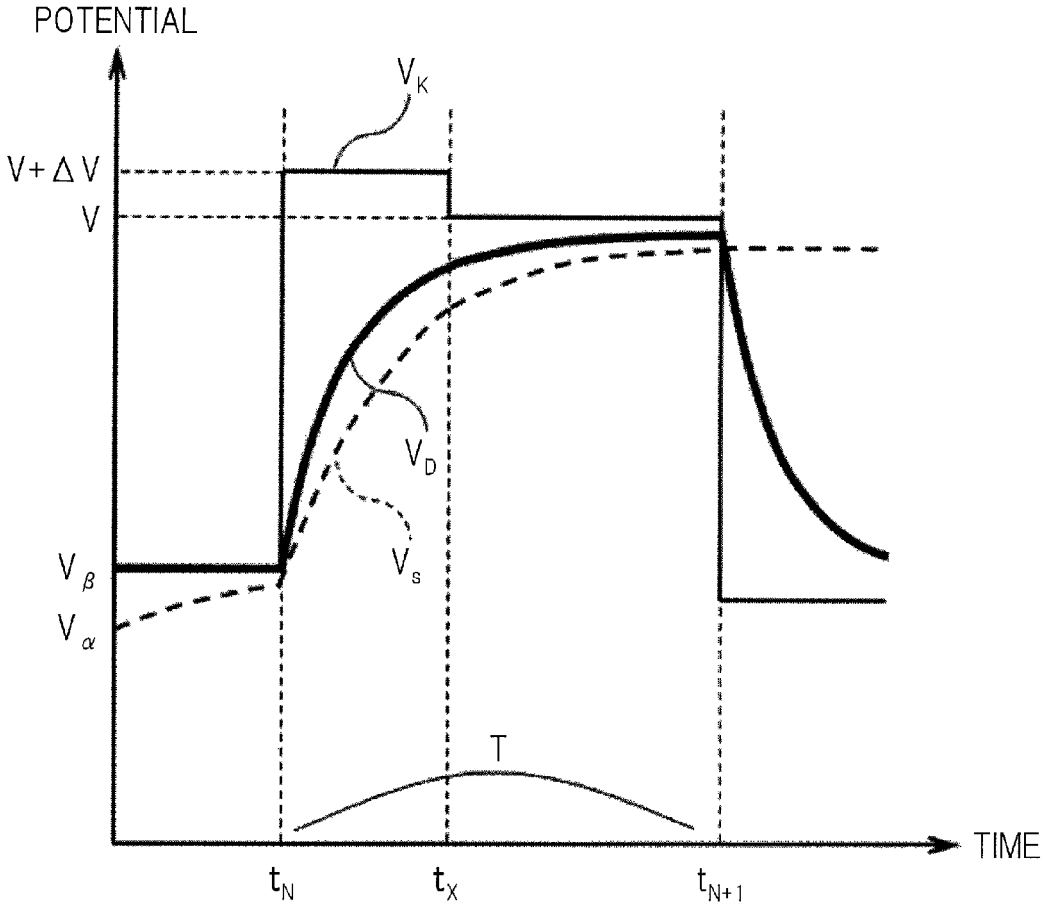

Before $t_N$, the drain voltage $V_D$ of the TFT 12 of the pixel of interest is affected by the video signal voltage $V_K$ for the pixel preceding the pixel of interest by one row. Therefore, $V_\beta$ which is the value of $V_D$ at the start time $t_N$ of the video signal output period is changed depending on the gradation signal voltage for the pixel preceding the pixel of interest by one row. FIG. 7B illustrates such a point, that is, as in the case of FIG. 7A, changes in video signal voltage $V_K$, drain voltage $V_D$ of the TFT 12, and potential $V_S$ of the pixel electrode 14 during the video signal output period. The potential $V_\beta$ is changed between FIGS. 7A and 7B.

In FIG. 7B, the potential $V_\beta$ of the video signal voltage $V_K$ for the pixel preceding the pixel of interest by one row is lower than the potential $V_\beta$ of FIG. 7A. Therefore, $V_\beta$ which is the value of $V_D$ at the start time $t_N$ of the video signal output period in FIG. 7B is lower than $V_\beta$ of FIG. 7A. As a result, V, of FIG. 7B is lower than V, of FIG. 7A.

Thus, in the case where ΔV is constant, before the time $t_{N+1}$ when the video signal output period is completed, $V_D$ reaches to the target potential V, and $V_S$ also reaches to the target potential V (FIG. 7A). However, in the case of FIG. 7B, there is a possibility that, before the time $t_{N+1}$, $V_D$ may not reach to the potential V, and $V_S$ may also not reach to the potential V. In other words, when ΔV is constant, there is a possibility that, before the time $t_{N+1}$, $V_S$ may not reach to the target potential V depending on a combination of the gradation signal voltage for the pixel preceding the pixel of interest by one row and the gradation signal voltage for the pixel of interest. Therefore, the deterioration of image quality cannot be reliably suppressed.

With respect to this point, the liquid crystal display device 2 is designed so that the control section 4 operates as follows to reliably suppress the deterioration of image quality. The point is described below.

[Details of Control Section]

Figure 8:
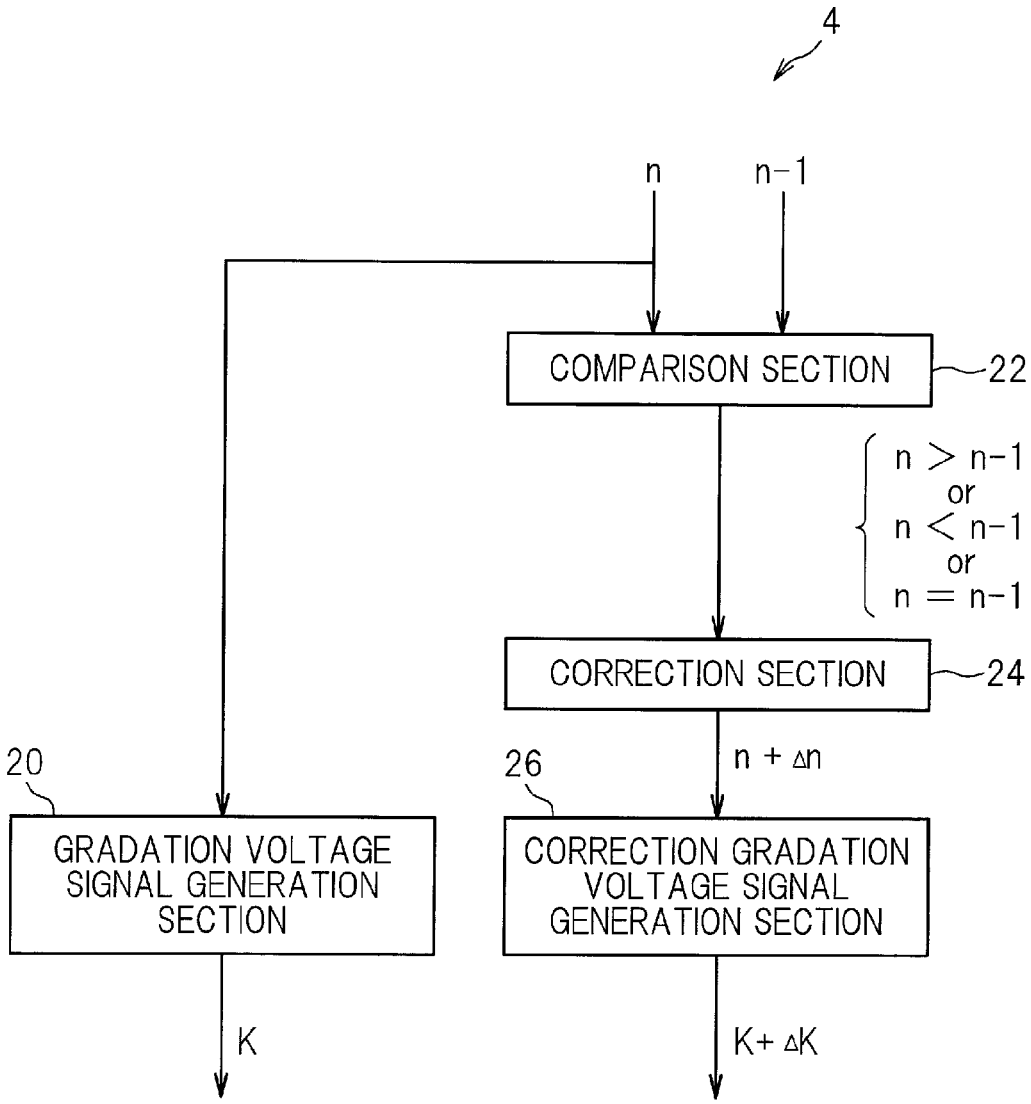
FIG. 8 illustrates a specific structure of a control section.

FIG. 8 illustrates a specific structure of the control section 4 (control means). As illustrated in FIG. 8, the control section 4 includes a gradation voltage signal generation section 20, a comparison section 22, a correction section 24, and a correction gradation voltage signal generation section 26.

In the liquid crystal display device 2, the respective pixels associated with the video data are selected in a predetermined order. In this embodiment, the respective pixels are selected in an order corresponding to sequential scanning. Every time each of the pixels is selected, the gradation voltage signal generation section 20, the comparison section 22, the correction section 24, and the correction gradation voltage signal generation section 26 operate as follows. Hereinafter, the selected pixel is referred to as the pixel of interest and the gradation value of the pixel of interest is expressed by "n". The gradation value of the pixel preceding the pixel of interest by one row is expressed by "n−1".

[Gradation Voltage Signal Generation Section]

That is, the gradation voltage signal generation section 20 generates a gradation voltage signal K corresponding to the gradation value "n" based on the gradation value "n" of the pixel of interest.

In this embodiment, a gradation signal voltage corresponding to a gradation value "0" is set as the gradation voltage signal K to be $V_{CEN}$ (see FIG. 4).

The gradation voltage signal generation section 20 outputs the gradation voltage signal K to the data line driving section 6. The data line driving section 6 outputs the gradation signal voltage V as the video signal voltage for the pixel of interest in accordance with the control signal.

A correction gradation voltage signal K+ΔK is generated by the comparison section 22, the correction section 24, and the correction gradation voltage signal generation section 26 based on the gradation value "n" of the pixel of interest and the gradation value "n−1" of the pixel preceding the pixel of interest by one row, which is stored in the line memory.

[Comparison Section]

That is, the comparison section 22 compares the gradation value "n" of the pixel of interest with the gradation value "n−1" of the pixel preceding the pixel of interest by one row, which is stored in the line memory. To be specific, the comparison section 22 obtains a magnitude relationship between the gradation value "n" of the pixel of interest and the gradation value "n−1" of the pixel preceding the pixel of interest by one row. That is, it is determined "whether or not the gradation value "n" of the pixel of interest is larger than the gradation value "n−1" of the pixel preceding the pixel of interest by one row", or it is determined "whether or not the gradation value "n" of the pixel of interest is equal to the gradation value "n−1" of the pixel preceding the pixel of interest by one row".

The comparison section 22 further obtains an absolute value |n| of the gradation value "n" of the pixel of interest and an absolute value |n−1| of the gradation value "n−1" of the pixel preceding the pixel of interest by one row.

[First Line Processing]

When the pixel of interest is a first-row pixel, the gradation value "n−1" of the pixel preceding the pixel of interest by one row is set to "0" for pseudo recognition. After that, the comparison section 22 obtains a magnitude relationship between the gradation value "n" of the pixel of interest and the gradation value "0" exhibiting the minimum gradation.

Then, the correction gradation voltage signal K+ΔK is generated by the correction section 24 and the correction gradation voltage signal generation section 26 based on the magnitude relationship between both the gradation values and the absolute values of both the gradation values.

[Correction Section]

That is, the correction section 24 corrects the gradation value "n" of the pixel of interest based on the magnitude relationship between both the gradation values and the absolute values of both the gradation values to obtain a correction gradation value n+Δn serving as a basis for generating the correction gradation voltage signal K+ΔK. Note that, Δn indicates a correction amount. In this embodiment, the correction section 24 reads, from the storage means, a lookup table (hereinafter, referred to as LUT) in which a condition related to the gradation value "n" of the pixel of interest, a condition related to the gradation value "n−1" of the pixel preceding the pixel of interest by one row, and Δs are associated with one another, and obtains Δs associated with a condition satisfying "n" and a condition satisfying "n−1". When the gradation value "n" of the pixel of interest is larger than the gradation value "n−1" of the pixel preceding the pixel of interest by one row, the correction section 24 calculates n+Δs as the correction gradation value n+Δn. In this case, the correction amount Δn is "Δs". On the other hand, when the gradation value "n" of the pixel of interest is smaller than the gradation value "n−1" of the pixel preceding the pixel of interest by one row, the correction section 24 calculates n−Δs as the correction gradation value n+Δn. In this case, the correction amount Δn is "−Δs".

When the gradation value "n" of the pixel of interest is equal to the gradation value "n−1" of the pixel preceding the pixel of interest by one row, the correction section 24 sets Δn to "0".

FIG. 9 illustrates an example of storage contents of the LUT. As illustrated in FIG. 9, the LUT is set to change the correction amount Δn depending on the magnitude relationship between the gradation values and the relationship between the absolute values of the gradation values. Therefore, the correction amount Δn is changed depending on a combination of the gradation value "n" of the pixel of interest and the gradation value "n−1" of the pixel preceding the pixel of interest by one row.

[Positional Correction]

A data line resistance value of the data line DL increases as a distance from the data line driving section 6 lengthens. A parasitic capacitance generated between the substrate and the data line DL also increases. Therefore, the rising speed of the drain voltage $V_D$ of the TFT 12 reduces as the distance from the data line driving section 6 lengthens.

Thus, in order to change the correction amount Δn depending on the distance from the data line driving section 6, a plurality of LUTs are stored in advance. The position of a row driven by the scanning line GL is determined by a longitudinal position information counter 27 (see FIG. 10) and a LUT corresponding to a longitudinal position is read from the storage means.

Figure 10:
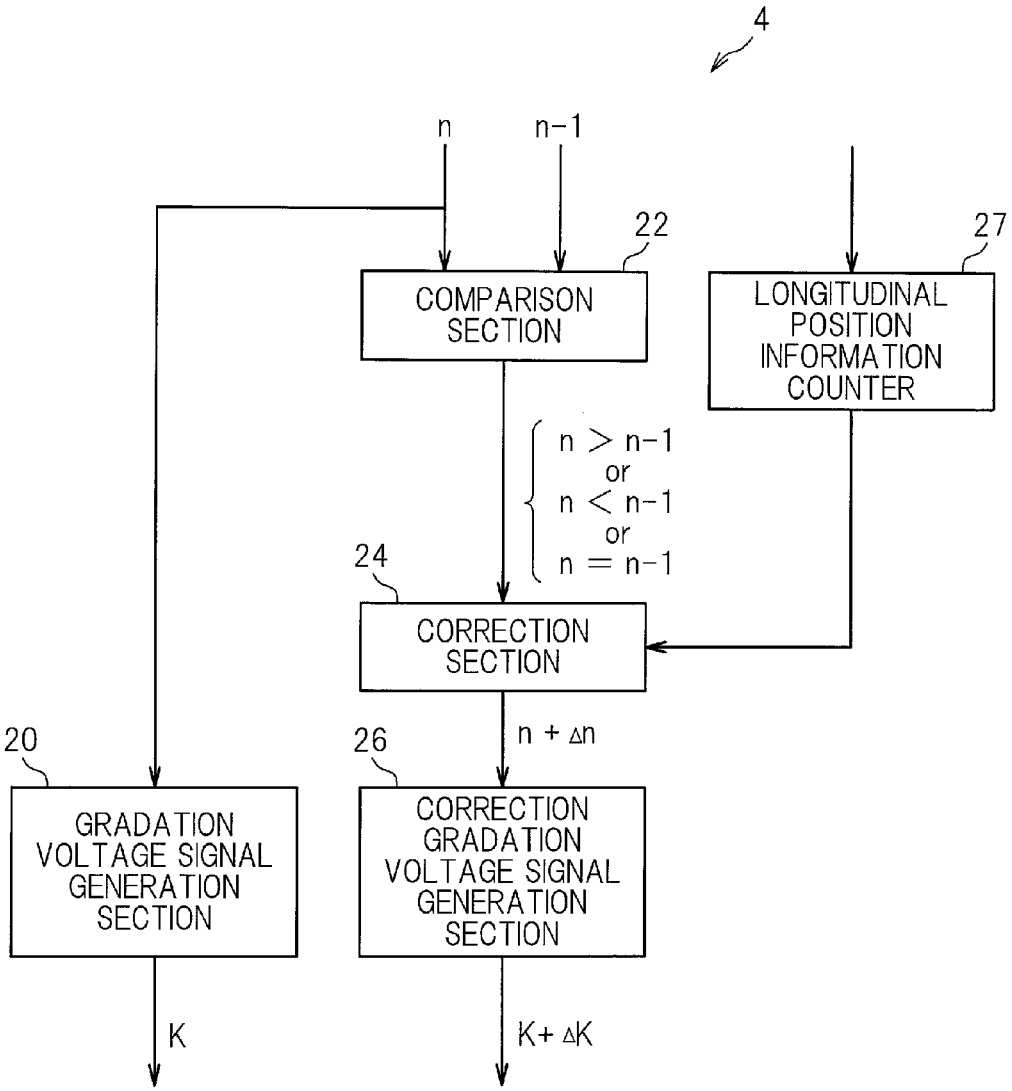
FIG. 10 illustrates a specific structure for a method of selecting a plurality of LUTs.

FIG. 10 illustrates a specific structure for a method of selecting one of the plurality of LUTs. A correction amount Δn between a plurality of LUTs is calculated by linear interpolation to suppress a steep change in correction amount Δn which is caused due to a variation in referenced LUTs.

[Correction Gradation Voltage Signal Generation Section]

The correction gradation voltage signal generation section generates the correction gradation voltage signal K+ΔK corresponding to the correction gradation value n+Δn based on the correction gradation value n+Δn.

When the correction gradation voltage signal K+ΔK is generated, the correction gradation voltage signal generation section 26 outputs the correction gradation voltage signal K+ΔK to the data line driving section 6. The data line driving section 6 outputs the correction gradation signal voltage V+ΔV as the video signal voltage $V_K$ for the pixel of interest in accordance with the control signal.

As described above, in the liquid crystal display device 2, the correction gradation signal voltage V+ΔV output as the video signal voltage $V_K$ for a certain pixel changes depending on the magnitude relationship between the gradation value "n" of the pixel of interest and the gradation value "n−1" of the pixel preceding the pixel of interest by one row and the relationship between the absolute values of the gradation values. In other words, a relationship between the gradation signal voltage V and the correction gradation signal voltage V+ΔV (that is, magnitude relationship between V and V+ΔV or difference between V and V+ΔV) changes depending on the combination of the gradation values "n" and "n−1". Therefore, the adjustment is performed so that, before the output of the video signal voltage $V_K$ for the pixel of interest is completed, the drain voltage $V_D$ of the TFT 12 of the pixel of interest reaches to the target potential V at the shortest time and thus the potential $V_S$ of the pixel electrode 14 reliably reaches to the target potential. As a result, the deterioration of image quality is reliably suppressed.

[Maximum Gradation Correction]

As is apparent from FIG. 9, for example, when the gradation value "n" of the pixel of interest is "255" and the gradation value "n−1" of the pixel preceding the pixel of interest by one row is "0", the correction amount Δn is a positive value, and hence the correction gradation value n+Δn is "285" exhibiting a gradation higher than the maximum gradation. Thus, in this case, the correction gradation signal voltage V+ΔV exceeds a voltage corresponding the gradation value "255" exhibiting the maximum gradation.

Therefore, in order to output the voltage corresponding to the gradation value "285" of the pixel from the data line driving section 6, the maximum gradation of the correction gradation voltage signal is set to "285" and the maximum gradation of the gradation voltage signal is set to "255".

Figure 11:
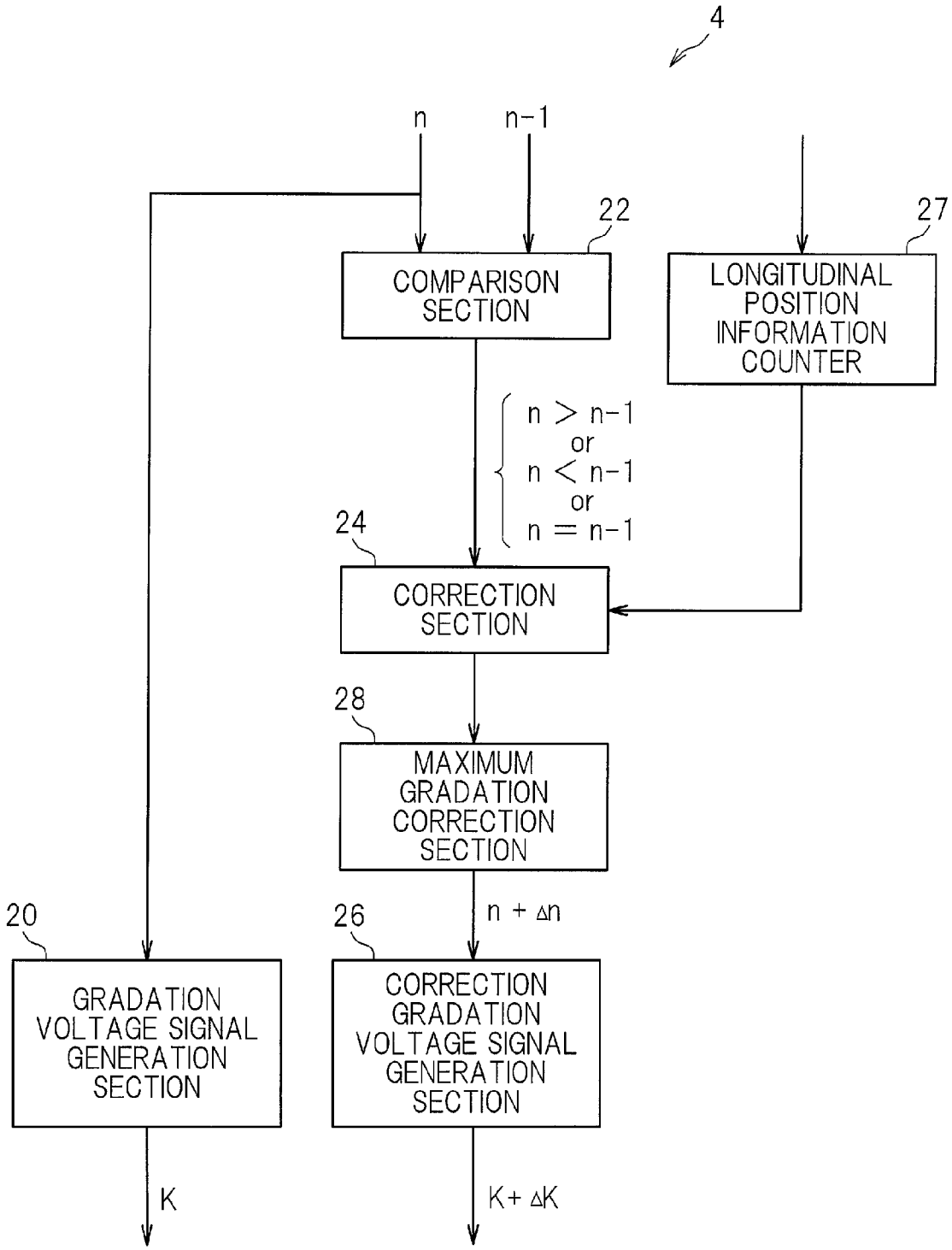
FIG. 11 illustrates a specific structure of a control section including a maximum gradation correction section.

FIG. 11 illustrates a specific structure of a control section 4 (control means) including a maximum gradation correction section 28. The comparison section 22 compares the gradation value "n" of the pixel of interest with the gradation value "n−1" of the pixel preceding the pixel of interest by one row. The correction section 24 generates the correction gradation value n+Δn based on the maximum gradation "285" and generates the corresponding correction gradation voltage signal K+ΔK. The gradation voltage signal generation section 20 generates the gradation voltage signal K for the pixel of interest based on the maximum gradation "255".

[Minimum Gradation Correction]

As is apparent from FIG. 9, for example, when the gradation value "n" of the pixel of interest is "0" and the gradation value "n−1" of the pixel preceding the pixel of interest by one row is "255" which is a voltage having the same polarity as the gradation signal voltage of the pixel of interest, the correction amount Δn is a negative value. Therefore, the correction gradation value n+Δn is "−30" different in polarity from the gradation value "0" of the pixel of interest and exhibits a voltage lower than the voltage corresponding to "0".

Therefore, in order to output the voltage corresponding to the gradation value "−30" of the pixel from the data line driving section 6, the minimum gradation of the correction gradation voltage signal is set to "−30" and the minimum gradation of the gradation voltage signal is set to "0".

Figure 12:
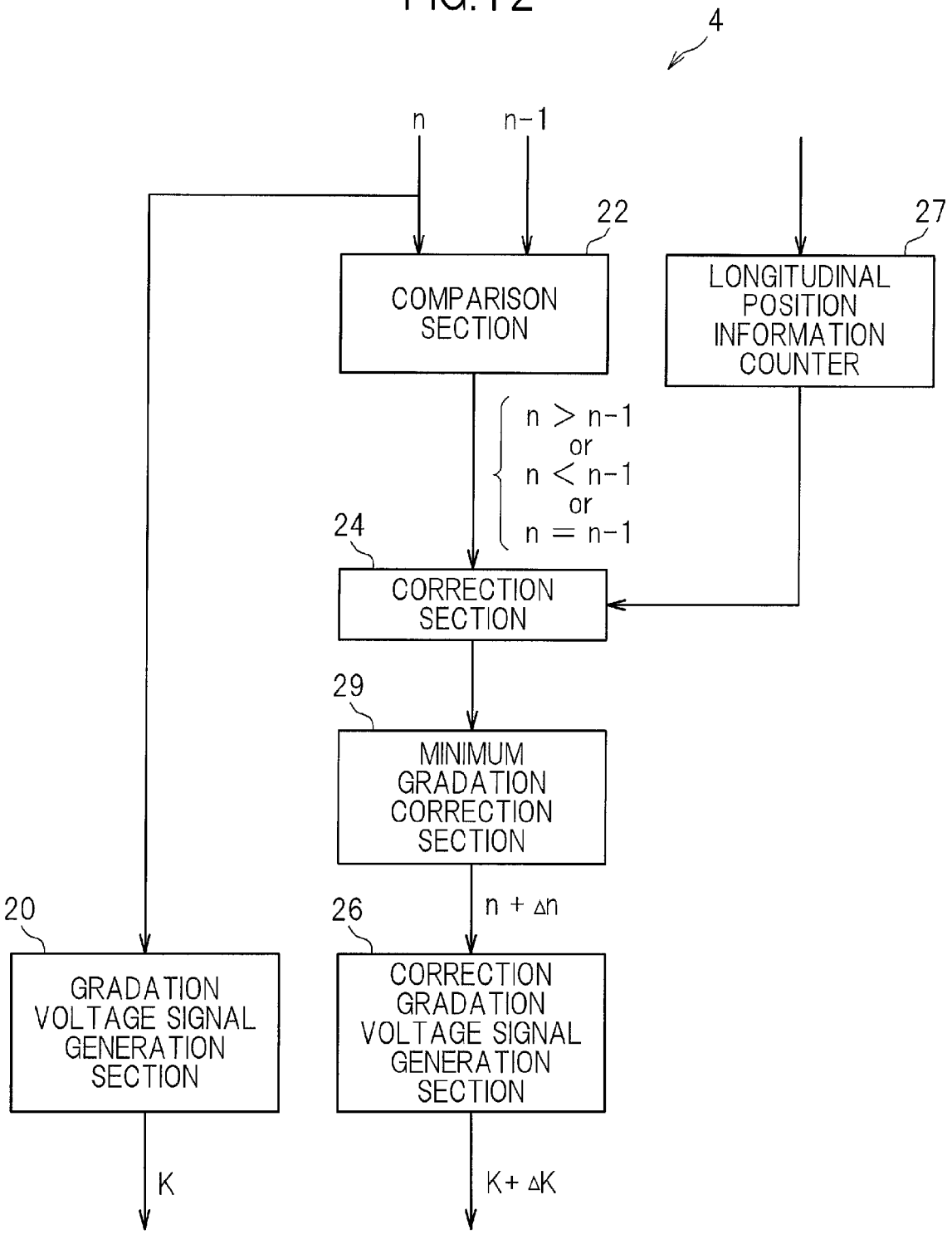
FIG. 12 illustrates a specific structure of a control section including a minimum gradation correction section.

FIG. 12 illustrates a specific structure of a control section 4 (control means) including a minimum gradation correction section 29. The comparison section 22 compares the gradation value "n" of the pixel of interest with the gradation value "n−1" of the pixel preceding the pixel of interest by one row. The correction section 24 generates the correction gradation value n+Δn based on the minimum gradation "−30" and generates the corresponding correction gradation voltage signal K+ΔK. The gradation voltage signal generation section 20 generates the gradation voltage signal K for the pixel of interest based on the minimum gradation "0".

Figure 13:
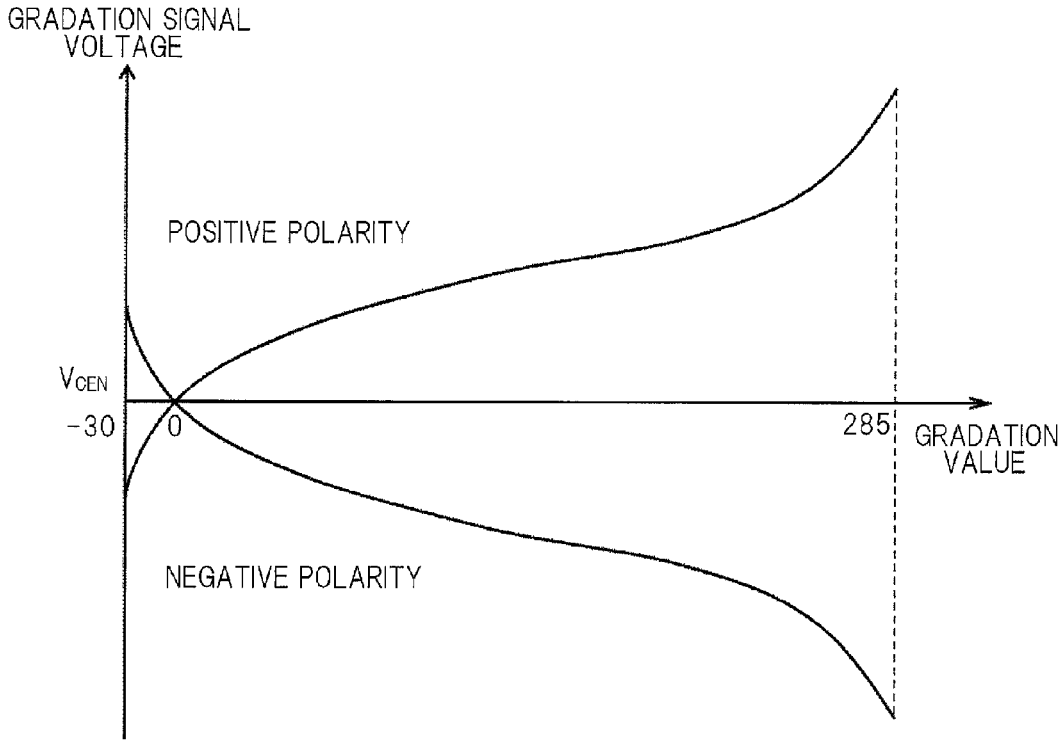
FIG. 13 illustrates a relationship between a gradation value and a gradation signal voltage in a case where maximum gradation correction and minimum gradation correction are performed.

FIG. 13 illustrates a relationship between the gradation value and the gradation signal voltages in a case where the operation is performed using the maximum gradation correction section 28 and the minimum gradation correction section 29. The gradation value is in a range of "−30" to "285". The gradation signal voltages having difference polarities are in a range of "−30" to "−1". A voltage exceeding the gradation signal voltage "255" for the pixel of interest is in a range of "256" to "285".

The present invention is not limited to the embodiment described above.

In the embodiment described above, the output of the on-voltage from the scanning line driving section 8 to the scanning line $GL_N$ is started while the video signal voltage for the pixel located in the (N−1)-th row preceding the N-th row by one row is output. However, for example, the output of the on-voltage may be started while a video signal voltage for a pixel located in a row preceding the N-th row by at least two rows is output.

For example, the comparison section 22 may compare the gradation value "n" of the pixel of interest with a gradation value of a pixel preceding the pixel of interest by at least two rows.

For example, the gradation signal voltage may be corrected to generate the gradation signal voltage as the correction gradation signal voltage.

For example, the correction amount Δn between the plurality of LUTs is calculated by nonlinear interpolation.

For example, the data line driving section 6 may output the video signal voltage for the first-row pixel for a period longer than a period of a video signal voltage for another-row pixel. For example, when the refresh rate is high, the video signal output period of the video signal voltage for the first-row pixel may be set to a period at least twice as long as a video signal output period of a video signal voltage of a pixel located in a row except the first row. In this case, the data line driving section 6 may be controlled by the control section 4 to output the video signal voltage for the first-row pixel for a period longer than a period of a video signal voltage for another-row pixel.

[Temperature Correction]

Characteristics of the TFT 12 change depending on a temperature, and hence the change speed of the potential $V_S$ of the pixel electrode 14 varies depending on the temperature. Thus, when the magnitude relationship between the gradation value "n" of the pixel of interest and the gradation value "n−1" of the pixel preceding the pixel of interest by one row and the relationship between the absolute values of the gradation values are set at a certain temperature, there is a possibility that the deterioration of image quality may be less suppressed than expected.

Therefore, the control section 4 may adjust the correction amount Δn based on the temperature. That is, the control section 4 may change the relationship between the gradation signal voltage V and the correction gradation signal voltage V+ΔV based on the combination of the gradation value "n"

and the gradation value "n−1" and the temperature. Hereinafter, an example of a structure for achieving such an operation is described.

Figures 14, 15:
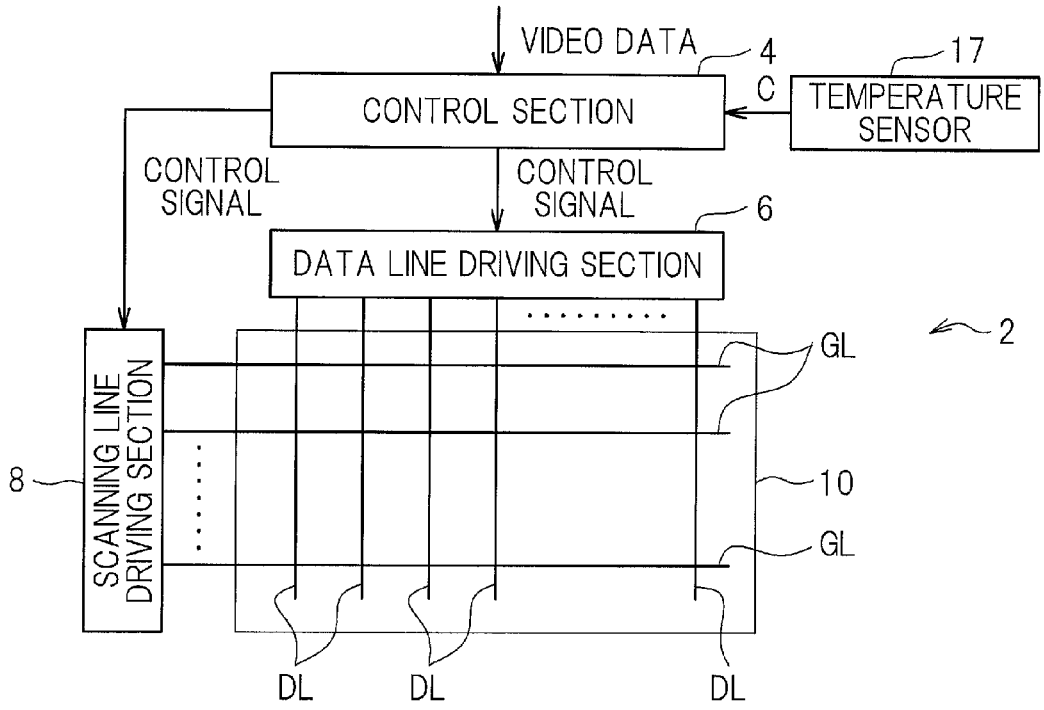
FIG. 14 is a structural diagram illustrating a liquid crystal display device.
FIG. 15 illustrates an example of a table.

FIG. 14 is a structural diagram illustrating a liquid crystal display device 2 which performs the operation described above. As illustrated in FIG. 14, in this structure, the liquid crystal display device 2 includes a temperature sensor 17. A temperature "C" is detected by the temperature sensor 17 and input to the control section 4. In this structure, a table in which conditions related to the temperature "C" are associated with coefficients γ is stored in the storage means in advance. FIG. 15 illustrates an example of the table.

On this assumption, the correction section 24 reads, from the table illustrated in FIG. 15, a coefficient γ associated with a condition satisfying the temperature "C", and calculates (n+(γ×Δn)) as the correction gradation value.

Therefore, even when the combination of the gradation value "n" of the pixel of interest and the gradation value "n−1" of the pixel preceding the pixel of interest by one row is the same, the correction gradation value changes depending on the temperature "C". As a result, the deterioration of image quality is reliably suppressed.

Instead of adjusting the correction amount Δn based on a pixel position, the control section 4 may change a period T1 for which the correction gradation signal voltage is output based on the pixel position in order to adjust the change speed of the potential $V_S$ of the pixel electrode 14 to a desired speed. For example, the control section 4 may determine the period T1 based on the position of a corresponding pixel for each pixel. For example, a table in which conditions related to the pixel position are associated with candidates of the period T1 may be prepared. The period T1 may be determined based on the candidate of the period T1 which is associated with a condition satisfying the position of the corresponding pixel for each pixel. Then, the control section 4 may control the data line driving section 6 to output the correction gradation signal voltage for the period T1.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a plurality of pixels each including a pixel electrode and a thin film transistor having a source connected to the pixel electrode;

a video signal line connected to a drain of the thin film transistor included in each of the plurality of pixels;

output means for outputting, to a gate of the thin film transistor, an on-voltage for turning on the thin film transistor included in corresponding one of the plurality of pixels for each of the plurality of pixels in a predetermined order; and video signal output means for outputting, to the video signal line, a video signal voltage for the corresponding one of the plurality of pixels for each of the plurality of pixels in the predetermined order, wherein the video signal output means outputs a reference video signal voltage having a voltage corresponding to a gradation value of the corresponding one of the plurality of pixels as the video signal voltage for the corresponding one of the plurality of pixels during a first part of a period during which the video signal voltage for the corresponding one of the plurality of pixels is output, and outputs a correction video signal voltage having a voltage different from the reference video signal voltage as the video signal voltage for the corresponding one of the plurality of pixels during a second part preceding the first part of the period, wherein the liquid crystal display device comprising a comparison means for comparing the gradation value of the corresponding one of the plurality of pixels with the gradation value of another one of the plurality of pixels which precedes the corresponding one of the plurality of pixels; and wherein the control means further comprises correction means for changing a relationship between the reference video signal voltage and the correction video signal voltage based on a result of the comparison means for the corresponding one of the plurality of pixels and based on a combination of the gradation value of the corresponding one of the plurality of pixels and a gradation value of another one of the plurality of pixels which precedes the corresponding one of the plurality of pixels.

2. A liquid crystal display device according to claim 1, wherein the output means starts to output the on-voltage for turning on the thin film transistor included in the corresponding one of the plurality of pixels when the video signal output means outputs a video signal voltage for the another one of the plurality of pixels which precedes the corresponding one of the plurality of pixels.

3. A liquid crystal display device according to claim 1, wherein the correction means corrects the gradation value of the corresponding one of the plurality of pixels to obtain a correction gradation value of the corresponding one of the plurality of pixels, wherein the video signal output means outputs the correction video signal voltage having a voltage corresponding to the correction gradation value of the corresponding one of the plurality of pixels as the video signal voltage for the corresponding one of the plurality of pixels, and wherein the control means controls a correction amount used when the correction means corrects the gradation value of the corresponding one of the plurality of pixels, based on the gradation value of the corresponding one of the plurality of pixels and the gradation value of the another one of the plurality of pixels which precedes the corresponding one of the plurality of pixels.

4. A liquid crystal display device according to claim 1, wherein the control means changes the relationship between the reference video signal voltage and the correction video signal voltage for the corresponding one of the plurality of pixels based on a position of the corresponding one of the plurality of pixels and the combination of the gradation value of the corresponding one of the plurality of pixels and the gradation value of the another one of the plurality of pixels which precedes the corresponding one of the plurality of pixels.

5. A liquid crystal display device according to claim 4, wherein:

the correction means corrects the gradation value of the corresponding one of the plurality of pixels to obtain a correction gradation value of the corresponding one of the plurality of pixels; and further comprising:

storage means for storing a table in which a condition related to the gradation value of the corresponding one of the plurality of pixels, a condition related to the gradation value of the another one of the plurality of pixels which precedes the corresponding one of the plurality of pixels, and correction amount control information are associated with one another, for each of the plurality of pixels, wherein the video signal output means outputs the correction video signal voltage having a voltage corresponding to the correction gradation value of the corresponding one of the plurality of pixels as the video signal voltage for the corresponding one of the plurality of pixels, and wherein the control means determines a correction amount used when the correction means corrects the gradation value of the corresponding one of the plurality of pixels, based on the correction amount control information associated with the condition satisfied by the gradation value of the corresponding one of the plurality of pixels and the condition satisfied by the gradation value of the another one of the plurality of pixels which precedes the corresponding one of the plurality of pixels in the table for the corresponding one of the pixels.

6. A liquid crystal display device according to claim 1, further comprising means for changing the second part of the period during which the video signal output means outputs the video signal voltage for the corresponding one of the plurality of pixels, based on a position of the corresponding one of the plurality of pixels.

7. A liquid crystal display device according to claim 1, wherein when the gradation value of the corresponding one of the plurality of pixels satisfies a predetermined condition, the video signal output means outputs the correction video signal voltage having a voltage exceeding a voltage corresponding to a maximum gradation as the video signal voltage for the corresponding one of the plurality of pixels.

8. A liquid crystal display device according to claim 7, wherein the correction means corrects the gradation value of the corresponding one of the plurality of pixels based on a correction amount corresponding to a combination of the gradation value of the corresponding one of the plurality of pixels and the gradation value of the another one of the plurality of pixels which precedes the corresponding one of the plurality of pixels to obtain a correction gradation value of the corresponding one of the plurality of pixels, wherein the video signal output means outputs the correction video signal voltage having a voltage corresponding to the correction gradation value of the corresponding one of the plurality of pixels as the video signal voltage for the corresponding one of the plurality of pixels, and wherein the correction means obtains a gradation value exhibiting a gradation higher than a maximum gradation as the correction gradation value of the corresponding one of the plurality of pixels when the gradation value of the corresponding one of the plurality of pixels satisfies the predetermined condition.

9. A liquid crystal display device according to claim 1, wherein when the gradation value of the corresponding one of the plurality of pixels satisfies a predetermined condition, the video signal output means outputs the correction video signal voltage having a voltage different in polarity from a reference video signal voltage for the another one of the plurality of pixels which precedes the corresponding one of the plurality of pixels as the video signal voltage for the corresponding one of the plurality of pixels.

10. A liquid crystal display device according to claim 9, wherein the correction means corrects the gradation value of the corresponding one of the plurality of pixels based on a correction amount corresponding to a combination of the gradation value of the corresponding one of the plurality of pixels and the gradation value of the another one of the plurality of pixels which precedes the corresponding one of the plurality of pixels to obtain a correction gradation value of the corresponding one of the plurality of pixels, wherein the video signal output means outputs the correction video signal voltage having a voltage corresponding to the correction gradation value of the corresponding one of the plurality of pixels as the video signal voltage for the corresponding one of the plurality of pixels, and wherein the correction means obtains a correction gradation value different in sign from the gradation value of the another one of the plurality of pixels which precedes the corresponding one of the plurality of pixels when the gradation value of the corresponding one of the plurality of pixels satisfies the predetermined condition.

11. A liquid crystal display device according to claim 1, further comprising temperature detection means for detecting a temperature, wherein the control means changes the relationship between the reference video signal voltage and the correction video signal voltage for the corresponding one of the plurality of pixels based on the combination of the gradation value of the corresponding one of the plurality of pixels and the gradation value of the another one of the plurality of pixels which precedes the corresponding one of the plurality of pixels and the temperature detected by the temperature detection means.

12. A liquid crystal display device according to claim 1, wherein the control means changes the relationship between the reference video signal voltage and the correction video signal voltage for a first pixel of the plurality of pixels based on a combination of a gradation value of the first pixel and a gradation value exhibiting a minimum gradation.

13. A liquid crystal display device according to claim 1, wherein the video signal output means outputs a video signal voltage for a first pixel of the plurality of pixels for a period longer than a period of a video signal voltage for another one of the plurality of pixels.

* * * * *